US007739758B2

(12) United States Patent
Weedling et al.

(10) Patent No.: US 7,739,758 B2
(45) Date of Patent: Jun. 22, 2010

(54) SUPPORT PAD FOR A PATIENT TRANSFER MATTRESS

(75) Inventors: Robert E. Weedling, Center Valley, PA (US); James E. Weedling, Center Valley, PA (US)

(73) Assignee: Patient Transfer Systems, Inc, Center Valley, PA (US)

( * ) Notice: Subject to any disclaimer, the term of this patent is extended or adjusted under 35 U.S.C. 154(b) by 1135 days.

(21) Appl. No.: 10/935,946

(22) Filed: Sep. 8, 2004

(65) Prior Publication Data

US 2005/0034230 A1 Feb. 17, 2005

Related U.S. Application Data

(63) Continuation-in-part of application No. 10/143,139, filed on May 10, 2002.

(60) Provisional application No. 60/290,413, filed on May 11, 2001.

(51) Int. Cl.
*A61G 7/08* (2006.01)

(52) U.S. Cl. ..... 5/81.1 R; 5/81.1 HS

(58) Field of Classification Search ..... 5/81.1 R, 5/81.1 HS, 706–707; 180/125; 414/676
See application file for complete search history.

(56) References Cited

U.S. PATENT DOCUMENTS

| | | | | |
|---|---|---|---|---|
| 4,528,704 A | | 7/1985 | Wegener et al. | 5/81 R |
| 4,627,426 A | | 12/1986 | Wegener et al. | 128/132 R |
| 4,631,767 A | | 12/1986 | Carr et al. | 5/449 |
| 4,686,719 A | | 8/1987 | Johnson et al. | 5/81 R |
| 4,947,500 A | * | 8/1990 | Seiler | 5/713 |
| 4,991,244 A | * | 2/1991 | Walker | 5/400 |
| 5,065,464 A | | 11/1991 | Blanchard et al. | 5/81 R |
| 5,249,318 A | | 10/1993 | Loadsman | 5/453 |
| RE35,299 E | | 7/1996 | Weedling et al. | 5/81.1 T |
| 5,561,873 A | | 10/1996 | Weedling | 5/711 |
| 5,794,289 A | * | 8/1998 | Wortman et al. | 5/713 |
| 6,073,291 A | | 6/2000 | Davis | 5/711 |
| 6,145,142 A | * | 11/2000 | Rechin et al. | 5/706 |
| 6,240,584 B1 | | 6/2001 | Perez et al. | 5/713 |
| 2001/0023512 A1 | | 9/2001 | Perez et al. | 5/713 |

* cited by examiner

*Primary Examiner*—Fredrick Conley
(74) *Attorney, Agent, or Firm*—Drinker Biddle & Reath LLP

(57) ABSTRACT

A support pad includes a recess in an upper surface for receiving an inflatable transfer mattress. The recess may extend to a depth such that an upper surface of the transfer mattress is flush with the upper surface of the support pad when the transfer mattress is deflated. Alternatively, the recess may be adapted for receipt of a transfer mattress having an accessory on an upper surface of the mattress such that an upper surface of the accessory is flush with the upper surface of the pad. The support pad may include side and end portions to form an overlay adapted for placement on an underlying support member having larger dimensions than the transfer mattress. The support pad may also be sectioned to include one or more detachably connected portions to facilitate sliding removal of a transfer mattress from the recess of the support pad.

7 Claims, 15 Drawing Sheets

SUPPORT PAD FOR A PATIENT TRANSFER MATTRESS

CROSS-REFERENCE TO RELATED APPLICATIONS

This is a continuation-in-part of application Ser. No. 10/143,139, filed May 10, 2002, which claims priority from U.S. provisional application No. 60/290,413, filed May 11, 2001.

FIELD OF THE INVENTION

The present invention relates generally to inflatable air mattresses used for medical purposes. More particularly, the present invention relates to an inflatable patient transfer mattress including small holes in a bottom sheet to form a cushion of air beneath the mattress to facilitate sliding of the mattress along an underlying support surface.

BACKGROUND OF THE INVENTION

The most prevalently produced transfer mattresses at the current time have an array of laterally extending chambers arranged in a generally rectangular pattern in the center of the mattress, with a continuous, rectangular outer chamber extending around the periphery of the mattress. Several embodiments of this type are shown in U.S. Pat. No. 5,561,873. The top sheet of these transfer mattresses is usually a twill weave nylon fabric coated on one side with urethane to make it vapor permeable but waterproof.

Although these mattresses can be cleaned and disinfected after use with various germicidal cleaning solutions, it is preferable to keep the mattress surfaces protected from contact with infectious or contaminating body fluids. This has been accomplished in prior art air mattresses by providing a sanitary sheet, essentially identical to the top sheet of the mattress, which is folded and inserted in a pouch at the foot end of the mattress. This sheet, referred to as a "sani-liner", is intended to be removed from the pouch and laid over the top sheet of the deflated mattress before the patient is placed upon the mattress. When the mattress is then inflated, the sani-liner sheet protects the top surface of the mattress from potentially infectious material. The sani-liner can later be cleaned and disinfected, folded and returned to the pouch.

In practice, however, when hospital workers sometimes need to use the transfer mattress quickly, they do not always take time to remove the sani-liner from the pouch and cover the top sheet. Furthermore, when the sani-liner is removed or otherwise comes detached, it is often lost and not replaced. Thus, it would helpful to have a removable sanitary cover that is already in place over the top sheet when the mattress is deflated and stored, and that can be removed and cleaned or replaced with another cover after use. Consistent with the above, it would be useful to have a transfer mattress that includes fasteners for attaching various accessories, including sanitary covers, to the mattress.

It would also be useful to have a sectional air mattress comprising at least one inflatable transfer pad, with accessories to facilitate convenient repositioning of a patient in a bed, or to improve the ease of transferring a patient from a bed to a chair and vice versa.

SUMMARY OF THE INVENTION

According to one aspect of the present invention, a support pad for an inflatable transfer mattress includes a recess in an upper surface of the support pad for receiving the transfer mattress.

According to one embodiment, the recess of the support pad extends into the support pad from the upper surface of the support pad to a depth such that an upper surface of an inflatable transfer mattress received in the recess of the support pad is substantially flush with the upper surface of the support pad when the transfer mattress is in a deflated condition.

According to another embodiment, the recess of the support pad is adapted for receiving an inflatable transfer mattress having an accessory located on an upper surface of the transfer mattress. The recess extends into the support pad from the upper surface of the support pad such that an upper surface of the accessory on the transfer mattress is substantially flush with the upper surface of the support pad.

According to another aspect of the invention, there is provided an overlay for supporting a substantially rectangular patient transfer mattress on an underlying support member having longitudinal and transverse dimensions that exceed those of the patient transfer mattress. The overlay comprises a pad body including upper and lower surfaces defining a thickness therebetween and opposite sides and ends respectively defining a transverse width and a longitudinal length. The overlay also comprises a substantially rectangular recess in the upper surface of the pad body for receiving a transfer mattress. The recess in the pad body of the overlay has a transverse width and longitudinal length with respect to the pad body that are less than the width and length of the pad body such that the pad body includes side and end portions extending outwardly from a periphery of the recess. Preferably, the recess in the overlay pad body is substantially centrally located with respect to both the width and length of the pad body.

According to another aspect of the invention, the support pad is sectioned and comprises a pad body having at least one pad portion detachably connected to the pad body. The pad portion forms part of a periphery defined by the recess when the pad portion is connected to the pad body to facilitate sliding removal of a patient transfer mattress from the recess of pad body when the pad portion is detached from the pad body.

According to one embodiment, the pad body is substantially rectangular defining opposite sides and ends and the support pad includes side and end portions respectively located along the opposite sides and ends of the recess. Each of the end portions may be detachably connected to the pad body to facilitate lengthwise removal of a transfer mattress from either end of the recess. Alternatively, each of the side portions may be detachably connected to the pad body for sidewise removal of transfer mattress from either side of the recess.

BRIEF DESCRIPTION OF THE DRAWINGS

For the purpose of illustrating the invention, there is shown in the drawings a form which is presently preferred; it being understood, however, that this invention is not limited to the precise arrangements shown.

DETAILED DESCRIPTION OF THE DRAWINGS

Figure 1:
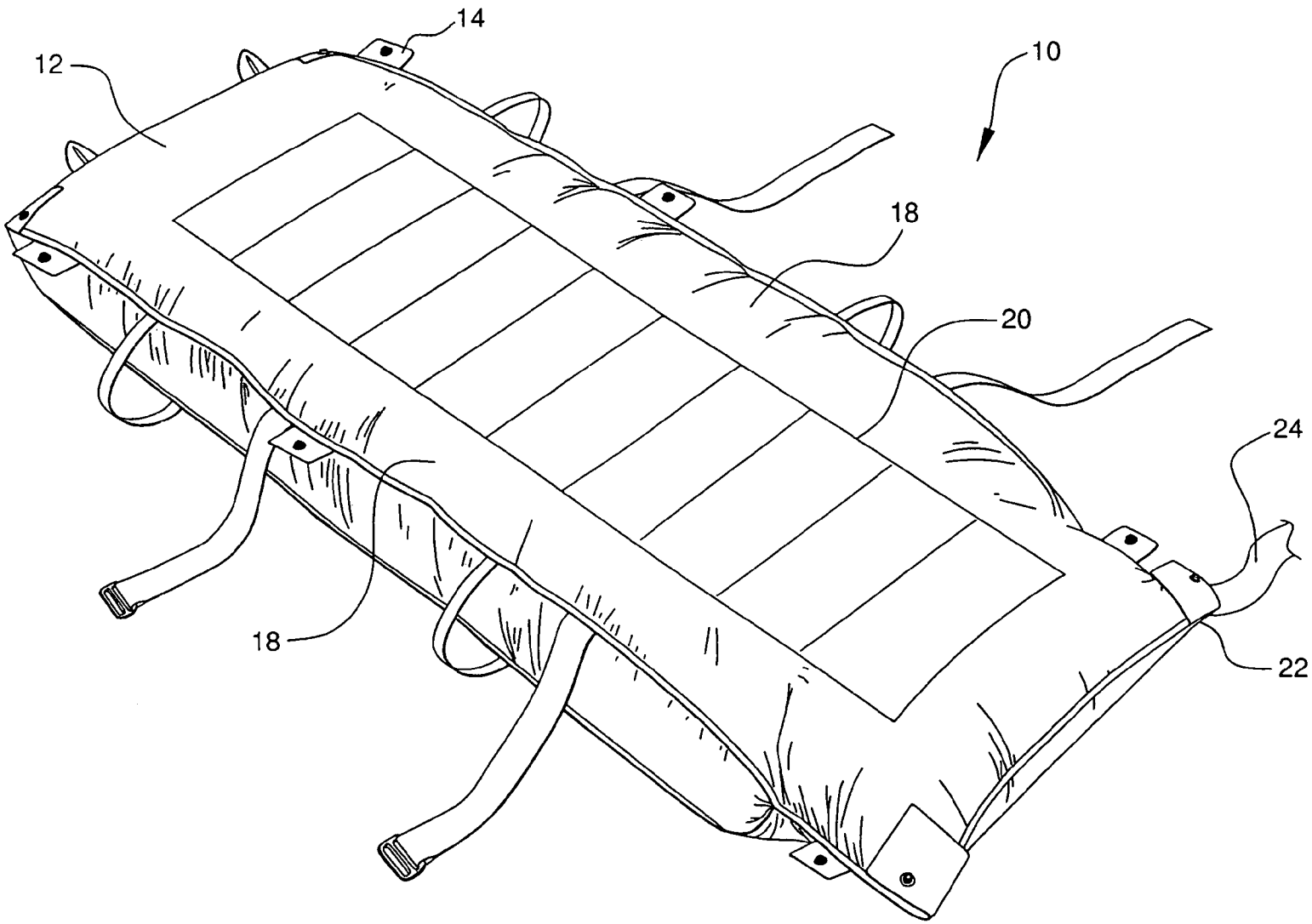
FIG. 1 is a perspective view of a patient transfer device, in accordance with an embodiment of the invention.

Referring now to the figures, there is shown in FIG. 1 one embodiment of patient transfer device 10. The patient transfer device 10 comprises at least one transfer mattress 12 and a plurality of fasteners 14 for attaching an accessory across a top surface of the mattress 12. The mattress 12 may include a generally rectangular array of transverse air chambers 16 supported at each longitudinal side thereof by a longitudinally-extending side air chamber 18. The transition between the transverse chambers 16 and side chambers 18 defining a seam 20 at each longitudinal side of the array.

The fasteners may be any type of fastener capable of attaching an accessory to the mattress 12 and the type of fastener may vary depending on the type of accessory. The fasteners may also be located anywhere on the mattress 12 or attached to the mattress 12 in any manner suitable in light of the accessory. In the embodiment depicted in FIG. 1, the fasteners are mounted on tabs attached to the longitudinally-extending side air chambers.

In FIG. 1, an inlet 22 for inflating the mattress 12 may be a closable opening wherein an air supply hose 24 is inserted and the inlet is snapped shut or otherwise closed to hold the hose in place while the mattress is being inflated. The inlet 22 may also include a valve biased to be normally closed to prevent air from exiting through the inlet and opened when the hose 24 is inserted into the inlet 22. Other arrangements known to those skilled in the art may be used to inflate the mattress 12.

The various types of accessories that may be attached to a transfer mattress are generally unlimited. By way of example, some preferred accessories include various types of covers, such as a non-absorbent sanitary cover, a washable absorbent cover or a disposable cover. Another useful accessory is a flexible body litter with carry handles. Other possible accessories include a wrap for wrapping around a patient or a garment worn by the patient to assist in moving the patient together with the transfer device; a cushion; an inflatable air mattress with a pressure control valve; an inflatable air mattress with pulsating pressure control; a non-inflatable mattress; and a therapeutic pad.

In an embodiment where the selected accessory is a cushion, the cushion may be releasably attached to the inflatable mattress or the cushion and mattress may be constructed as a single unit.

In embodiments where there is an inflatable air mattress, a top surface of the inflatable mattress may be inclined so that the head of a patient lying horizontally on the mattress is at a higher point with respect to a supporting surface than the feet.

Figure 2:
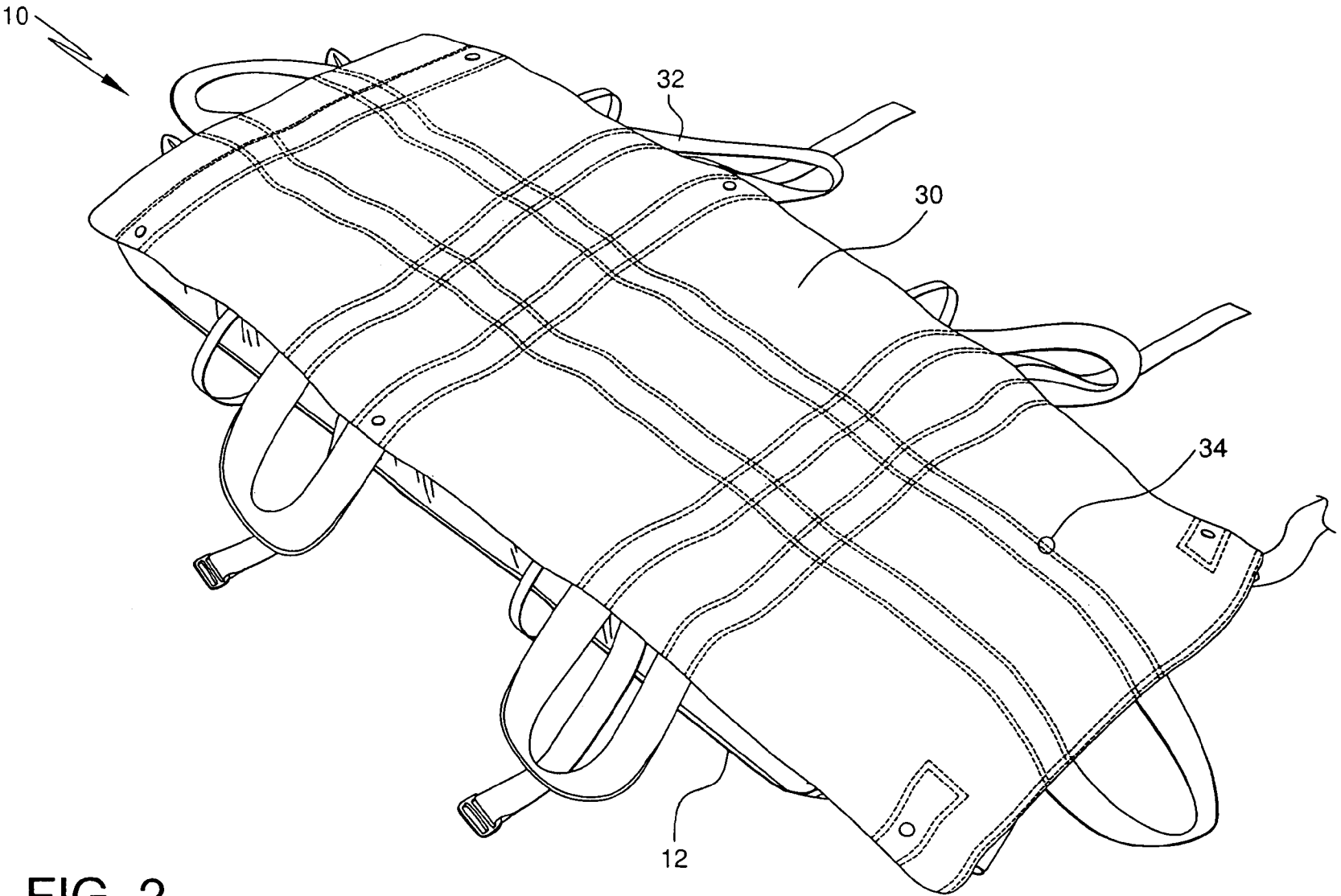
FIG. 2 is a perspective view of a patient transfer device comprising a body litter attached to a top surface of a transfer mattress adapted for transferring a patient from one surface to another, in accordance with an embodiment of the invention.

Referring now to FIG. 2, the patient transfer device 10 is shown with an accessory attached. The accessory is a body litter 30 having carry handles 32. The carry handles are a loop of fabric sewn to the litter 30 as shown by the stitching 34 running between each pair of handles 32. The loop is preferably continuous as shown. In a preferred embodiment, at least two pair of carry-handles extend outward from the mattress. In the depicted embodiment, there are three pairs of carry handles 32, two at the sides and one at each end.

Figure 2A:
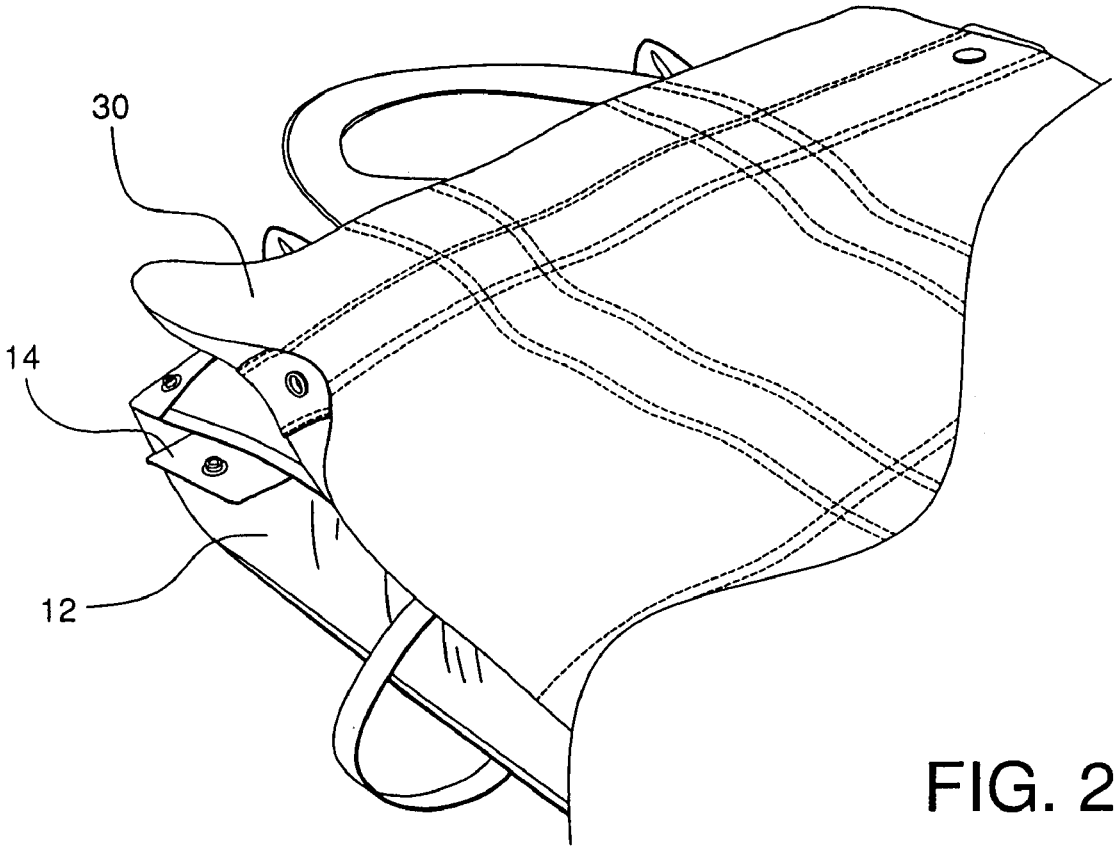
FIG. 2A is a partial view of the patient transfer device shown in FIG. 2 wherein at a corner of the device the body litter is partially removed, in accordance with an embodiment of the invention.

The body litter 30, or any other accessory, may be attached to the transfer mattress 12 using any type of fastener or suitable means of fastening. The selected accessory and mattress may alternatively be fixedly attached or otherwise constructed as a single unit. In FIG. 2A, the fastener is a snap fastener. As shown in FIG. 2A, the tabs 14 have snaps which can attach to snaps located at corresponding positions on the body litter 30, or any accessory. The fasteners 14 may be located outboard of the seams defined by the transition between the transverse chambers and the side chambers. The fasteners may also be mounted on tabs attached to the longitudinally-extending side air chambers, as shown in FIG. 1.

Figure 2B:
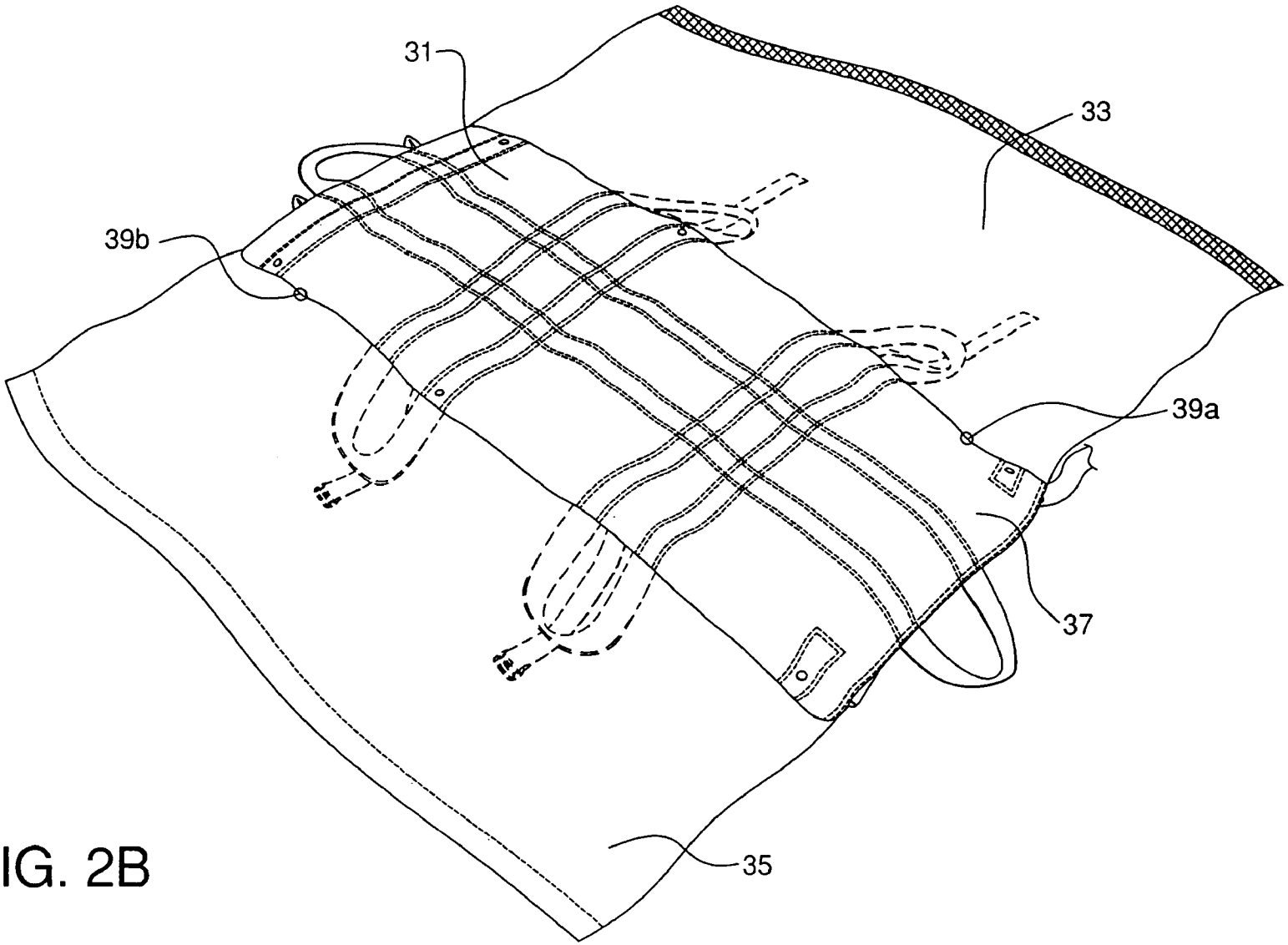
FIG. 2B is a perspective view of a patient transfer device comprising a body litter having flaps, in accordance with an embodiment of the invention.

A preferred body litter 31 is shown in FIG. 2B. The body litter 31 depicted in FIG. 2B includes flaps 33, 35 that extend outward from each side of the body litter 31. When not in use, flap 33 may be folded over the litter's center panel 37 along line 39*a*. Similarly, flap 35 may be folded over the litter's center panel along line 39*b*. If a patient laying on the transfer device is pronounced dead or if a body needs to be transferred, the flaps 33, 35 may be opened as shown in FIG. 2B allowing the body to be covered and transported using one or more pair of carry handles that are preferably attached to the litter's center panel 37. The flaps 33, 35 may also be thermally coated and used to warm patients in shock or who otherwise need to be warmed.

Figure 3:
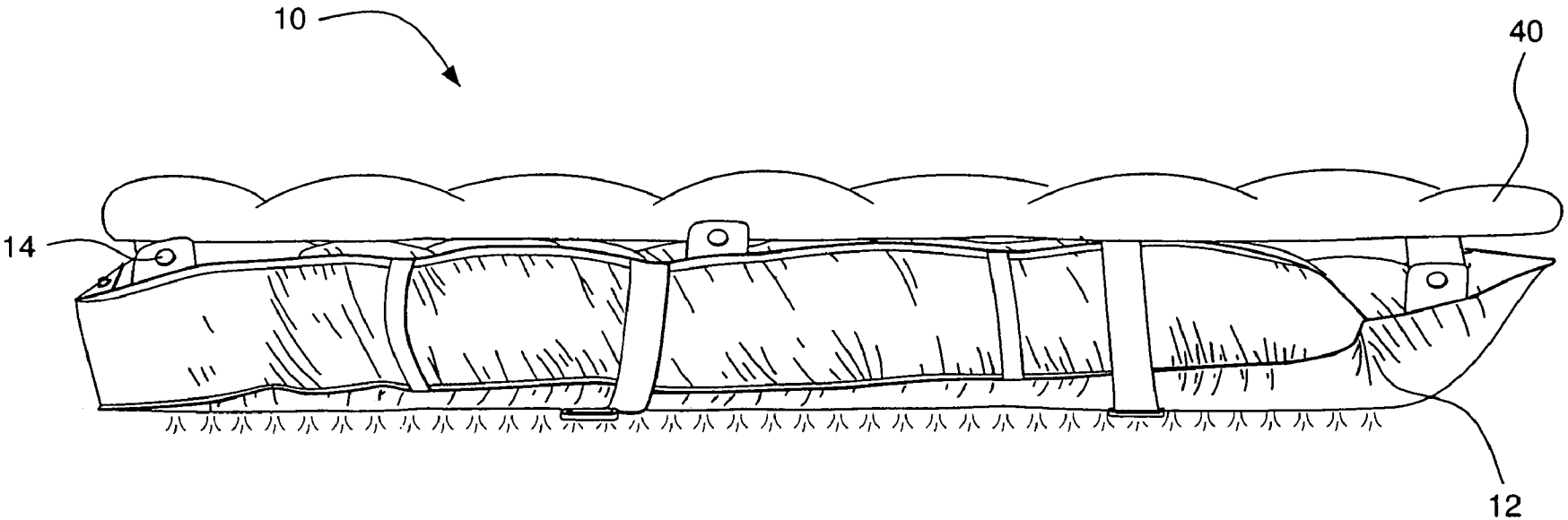
FIG. 3 is an elevation view of a patient transfer device comprising a transfer mattress adapted for transferring a patient from one surface to another with an inflatable mattress attached to the transfer mattress, in accordance with an embodiment of the invention.

In a transfer device, the transfer mattress has a bottom sheet with a pattern of tiny holes to allow the escape of air supplied into the mattress by a low-pressure air supply. The air supplied to the transfer mattress escapes through the holes, providing a weight-bearing cushion to facilitate sliding the mattress along a surface as well as from one surface to another. In FIG. 3, an embodiment is shown in which the accessory is an inflatable mattress 40, which may have a pressure control valve or pulsating pressure control. The inflatable mattress 40 may include a top surface that is inclined so that the head of a patient lying horizontally on the mattress is at a higher point with respect to a supporting surface than the feet. The mattresses 12, 40 may be releasably attached as shown with snaps. The mattresses 12, 40 may also include at least one sheet, either top or bottom or both, that is rigid or substantially rigid to cause a surface to remain relatively level while the mattress is inflated.

In the embodiment shown in FIG. 3, it should be understood that the second mattress 40 is not limited to being an air mattress, but may be any type of mattress or pad depending on the needs of the patient. For instance, it is very common for closure of a patient's capillaries to be a concern for patients that are confined to a bed for an extended period. In such situations, any type of accessory that will prevent capillary closure may be attached to the transfer mattress 12. For example, any type of therapeutic pad, such as for example a gel pad, may be attached to the transfer mattress 12 to ensure patient comfort and reduce the risk of capillary closure. Where the mattress 40 is inflatable, however, a variable pressure air supply may be used so appropriate pressure levels may be delivered to each mattress, as desired. For example, the inflatable mattress 40 may be inflated using a lower degree of pressure than the transfer mattress 12.

Figure 4:
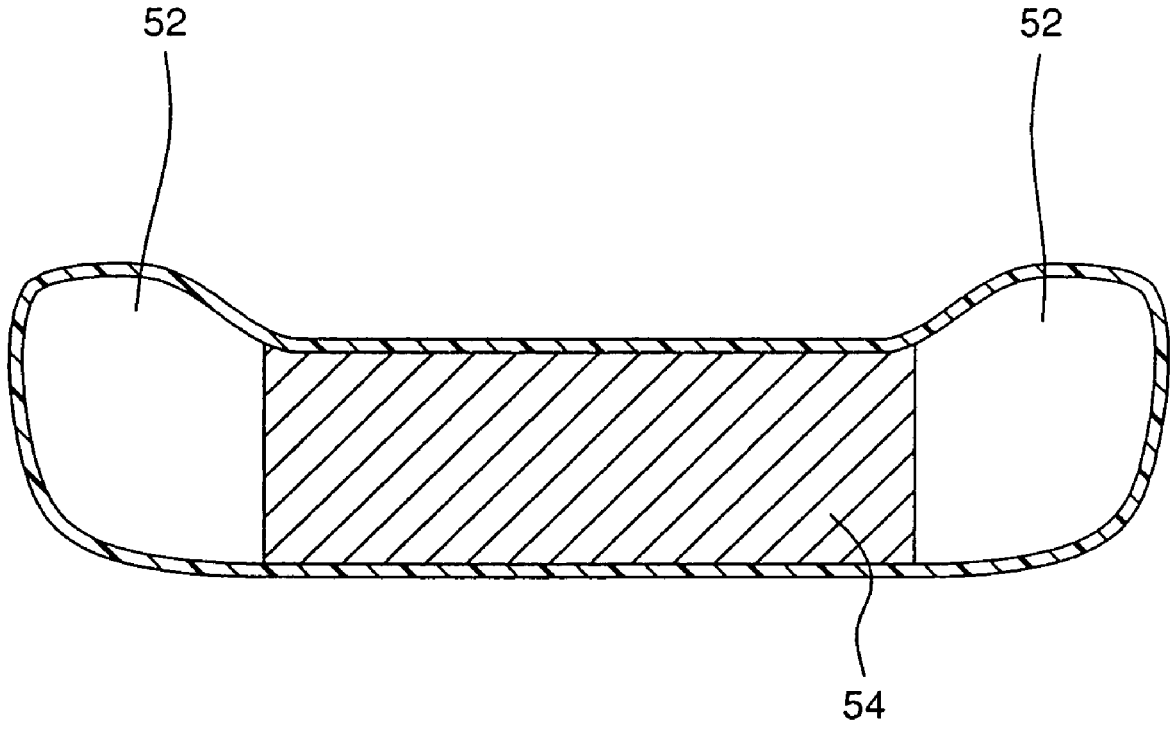
FIG. 4 is a cross-sectional view of a patient transfer device wherein a transfer mattress is adapted to assist in centrally locating a patient on the mattress and showing an interior partition to prevent the mattress from hot-dogging, in accordance with an embodiment of the invention.

The transfer and inflatable mattresses may be constructed in any shape or size. For example, the transfer mattress may be constructed so that the apex distance between top and bottom sheets, when the pads are inflated, is greater outboard of the seam than in the array of transverse chambers to bias the patient towards the center of the pad by creating the effect of an inverted pontoon at each longitudinal side of the array. FIG. 4 shows a cross-sectional view of a transfer mattress or pad constructed in that shape. This shape is especially useful for helping to center a patient on the mattress and providing additional security for the patient. The transfer mattress can also be constructed such that the plenum chamber 52 of the pontoon extend downward. Adjusting the distance of transverse partition members between top and bottom sheets causes variations in the shape of a mattress. To adjust the distance between sheets, the height of the partition 54 may be adjusted, as desired.

Figure 5:
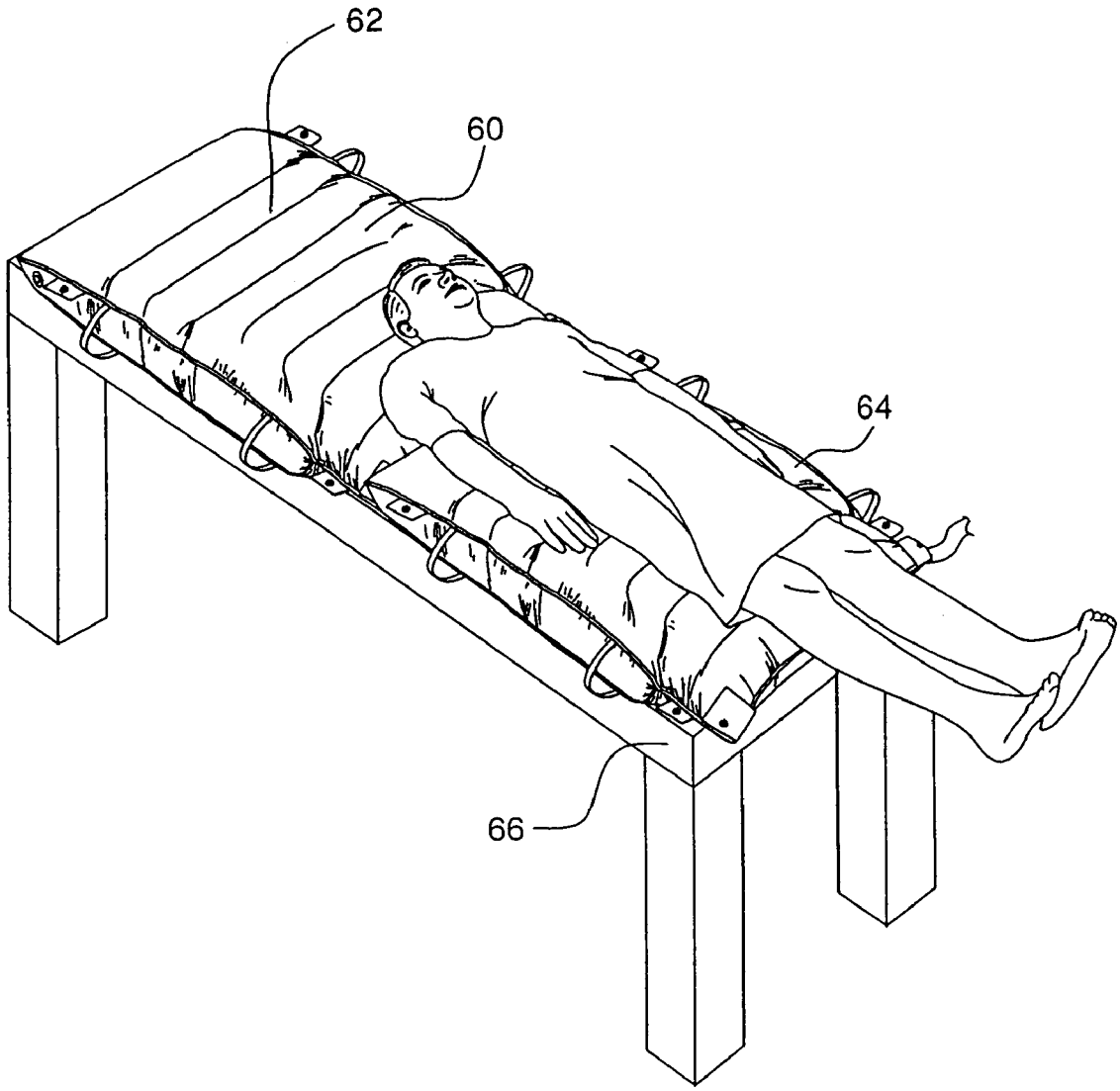
FIGS. 5 and 6 are a patient transfer device comprising a sectioned mattress formed with two inflatable pads, in accordance with an embodiment of the invention.
Figure 6:
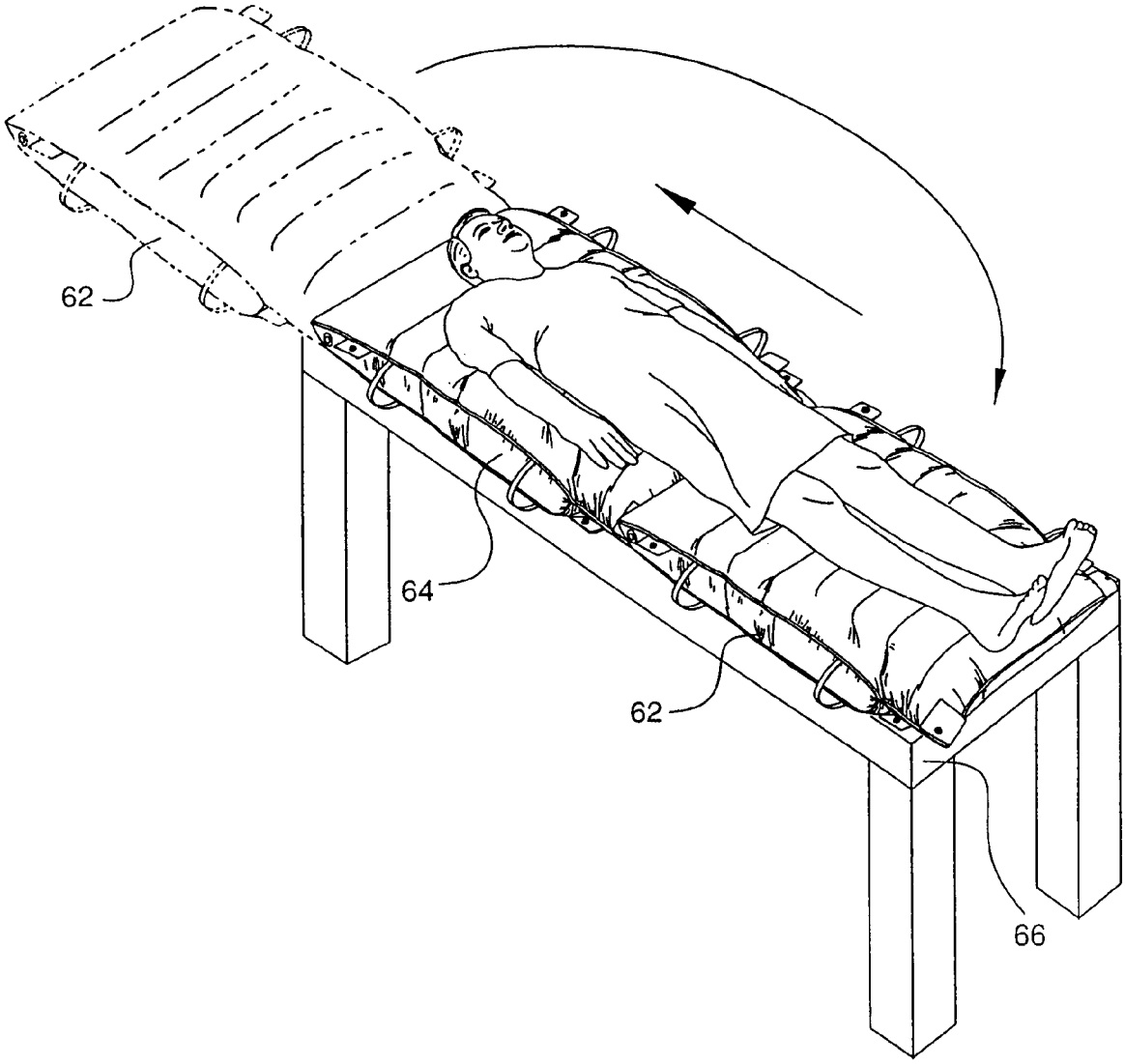

Moving to FIGS. 5 and 6, an embodiment of the patient transfer device may include a sectional mattress 60 having a plurality of inflatable pads 62, 64, at least one being a transfer pad having a bottom sheet with a pattern of tiny holes to allow the escape of air to facilitate sliding the pad from one surface to another. In this embodiment, each pad may have means for attaching to another pad to form a complete mattress 60 for a patient. The attachment means may be a snap, belt, or hook and loop fastener, for example. There may be any number of pads but the overall collective size of the pads when attached together will generally be similar in size to a typical hospital bed. In FIG. 5, the sectioned mattress 60 is shown as comprising two inflatable pads 62, 64, each less than about half the size of a typical hospital bed. The embodiment is useful because a patient laying on a hospital bed 66 will often slide down toward the foot end of the bed. In such situations, staff members typically physically pull the patient back towards the headboard. This process is often painful for the patient and a major cause of muscular skeletal disability for staff members. Having a sectioned inflatable mattress 60 comprising one or more inflatable pads 62, 64 as shown in FIG. 5 allows the patient to be repositioned more effectively and safely, as described below.

In FIG. 5, the patient is shown partially slid downward on a hospital bed 66. The sectioned mattress 60 of the present invention is between the bed 66 and the patient. The patient can be repositioned slightly so that his upper body will be completely supported by the lower inflatable pad 64 once it is inflated. (Note, the more pads used to form the mattress 60, the less likely the patient will have to be repositioned prior to inflating the pads.)

Once the patient is in-place on pad 64, the top pad 62 may be removed. The pad 64 supporting the patient's torso is then inflated and slid upward so the patient is again properly positioned in the bed. The pad 62 is then reattached at the bottom of pad 64. The process may be repeated as necessary. Alternatively, if appropriate, after the top pad 62 is removed, it may be reattached and then inflated so that both pads 62 and 64 are used to reposition the patient as desired. Of course, the pads 62, 64 may also be inflated to move the patient from the bed to another supporting surface.

The embodiment of the invention shown in FIGS. 5 and 6 and described above, may, like other embodiments, include fasteners for attaching any type of accessory, as desired. More specifically, each pad may further include a plurality of fasteners for attaching an accessory across a top surface of a sectioned mattress formed by pads 62, 64 being attached together. The pads also include fasteners for attaching one pad to another pad and may be located on tabs that are attached to the pads at various locations, as desired.

The pads 62, 64 may include a top sheet and a bottom sheet, the top and bottom sheets being attached to each other by internal fabric strips forming a generally rectangular array of transverse air chambers supported at each longitudinal side thereof by a longitudinally-extending side air chamber. In such cases, the fasteners may generally be located outboard of the seams defined by the transition between the transverse chambers and the side chambers.

A transfer mattress, inflatable mattress, sectioned mattress, and inflatable pads, may be constructed to keep a patient level with respect to a supporting surface. When a patient is laying horizontally, the patient's torso typically imposes the greatest load on a mattress. This is of particular significance for air mattresses. If an air mattress is not constructed to properly support the patient's torso with respect to his feet and head, a patient may be forced to lay on the mattress with his feet and/or head above his torso, which is uncomfortable and could result in potentially harmful spinal flex. Therefore, it is desirable to construct the interior of an air mattress similar to what is shown in U.S. Pat. No. 5,561,873. In the '873 patent, the interior of an air mattress is constructed so that the amount of air pressure provided at various parts of the mattress correspond to the load to keep the patent substantially horizontal with respect to an underlying surface.

Figure 7A:
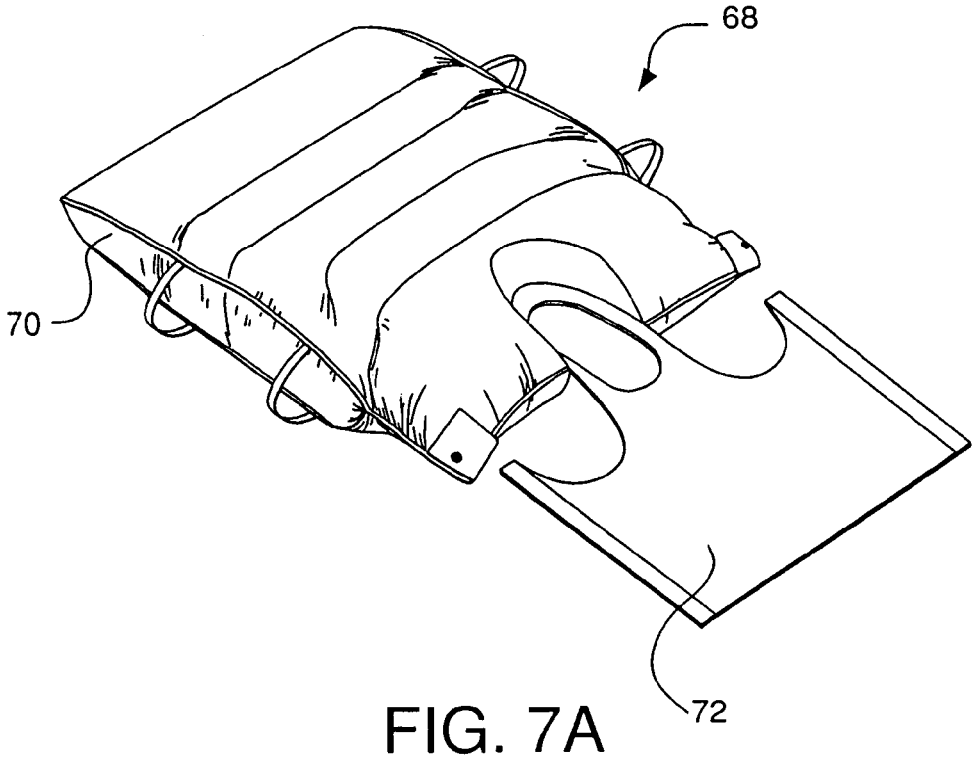
FIGS. 7A and 7B are a wearable patient transfer device comprising a transfer mattress and a garment, in accordance with an embodiment of the invention.
Figure 7B:
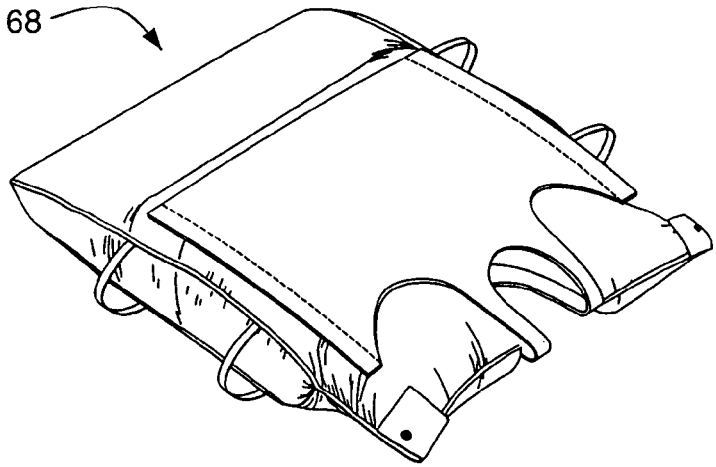
Figure 8:
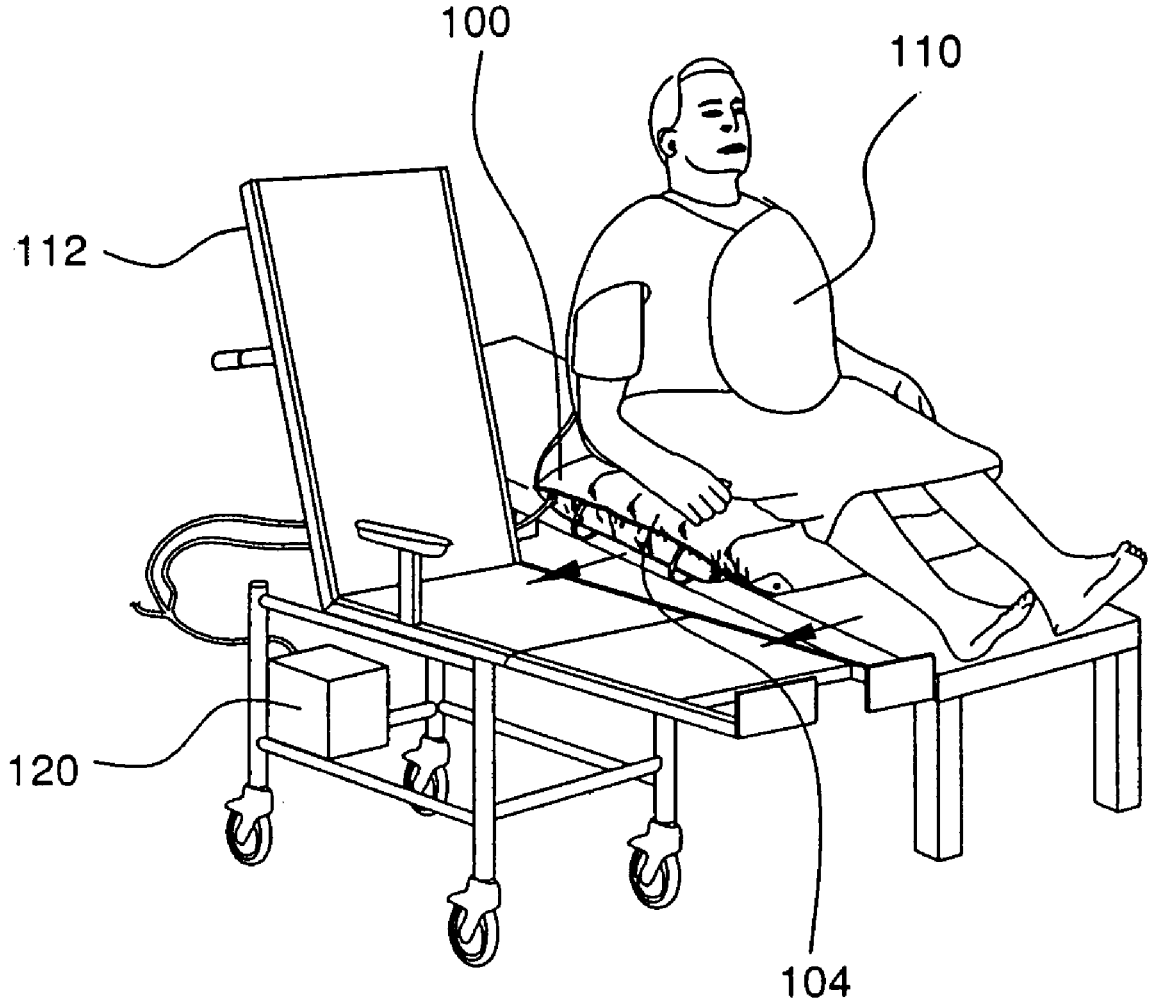
FIG. 8 is a wearable patient transfer device comprising a transfer mattress and a vest, in accordance with an embodiment of the invention.

Referring now to FIGS. 7A, 7B, and 8, embodiments of a patient transfer device 68 that patients can be attached to or worn by a patient are shown. In FIGS. 7A and 7B, the patient transfer device 68 comprises a transfer mattress 70 having a body garment 72 which allows the device 68 to be worn like a pair of shorts. The garment 72 may be any accessory capable of causing the patient to move together with the mattress 70. By way of example, a suitable accessory 68 may be a typical three-point harness used in baby products. If a patient wearing the device slides down in bed or otherwise needs to be repositioned, the mattress 70 may be inflated and the patient slid upward, safely and easily. The transfer mattress 70 preferably includes an opening to allow an attendant to position a bed pan beneath the patient, if necessary or desired.

The patient transfer device 68 is shown open is FIG. 7A and closed in FIG. 7B. Depending on the condition and preference of the patient, the device 68 may be arranged in FIG. 7A underneath a patient and attached to the patient, as desired. Alternatively, the device may be arranged as shown in FIG. 7B allowing a patient to wear the device 68 like a pair of shorts. The device 68 may be attached to a patient mattress to assist in preventing the patient from sliding down in bed.

In FIG. 8, a second wearable embodiment of patient transfer device 100 is shown. Here, the device 100 comprises a transfer mattress 104 having a wrap 110 for moving the patient together with the mattress 104. When a patient is transferred, the wrap 110 may be worn as shown, the mattress 104 inflated, and the patient transferred from the bed to, for example, a chair. The wrap 110 is attached to the mattress 104 and, in the depicted embodiment, includes openings for the arms as shown. Arm movement may be restricted, if necessary, by leaving the patient's arms inside the wrap 110 or using a wrap 110 made without arm holes. For convenience, an air supply 120 may be attached directly to a chair 112 or any object into or onto which a patient will be transferred.

Figure 9A:
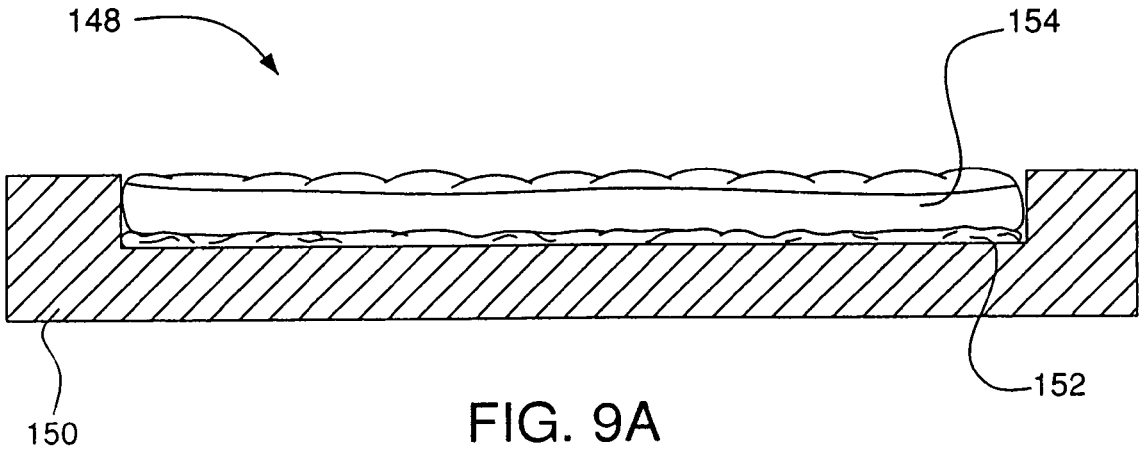
FIGS. 9A and 9B are a patient transfer device comprising a mattress having a recessed portion for receiving a patient transfer device, in accordance with an embodiment of the invention.
Figure 9B:
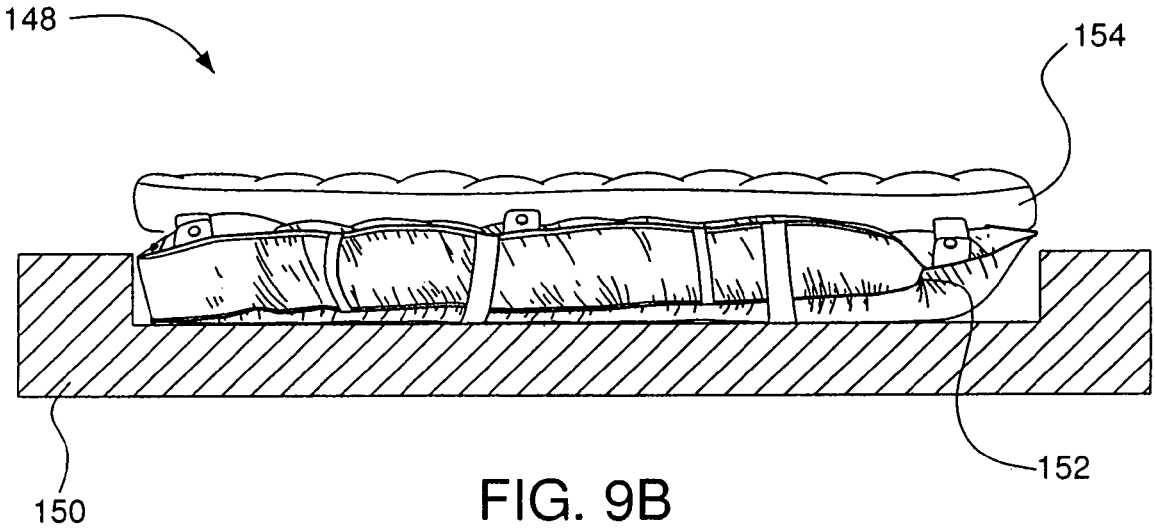
Figure 10:
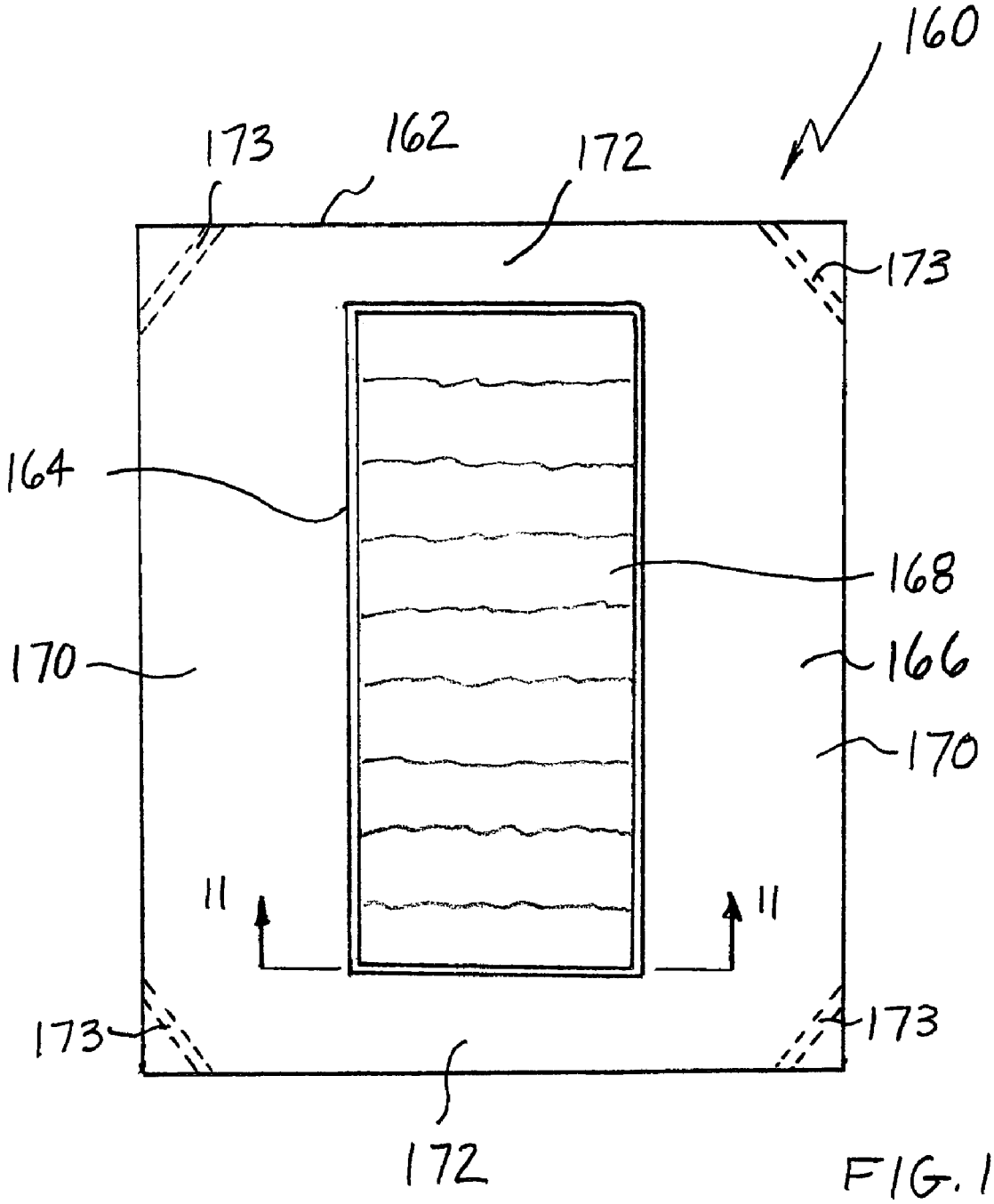
FIG. 10 is a patient transfer device comprising a support pad having a recess in an upper surface in which a patient transfer mattress is received.

Referring now to FIGS. 9A and 9B, there is shown an embodiment of patient transfer device 148 comprising a patient transfer mattress 150 having a recessed portion. In the depicted embodiment, the device includes a transfer mattress 152 with an inflatable mattress 154 attached to it. In FIG. 9A, the inflatable mattress 152 is deflated. Referring to FIG. 10, the transfer device 148, in similar manner as the above-described transfer devices, preferably includes a bottom sheet 153 having a plurality of small holes 155 providing a weight-bearing cushion of escaping air to facilitate sliding of the mattress along an underlying support surface. The height of the inflatable mattress 154 is preferably approximately equivalent to the height of the recess. To transfer a patient, the transfer mattress 152 may be inflated as shown in FIG. 9B and transferred to another supporting surface. The width of the recessed portion may be equal to or less than the width of the patient mattress 150. Where the width of the recessed portion is less, the longitudinal edges of the mattress 150 may be removable or hingedly attached.

Figure 11:
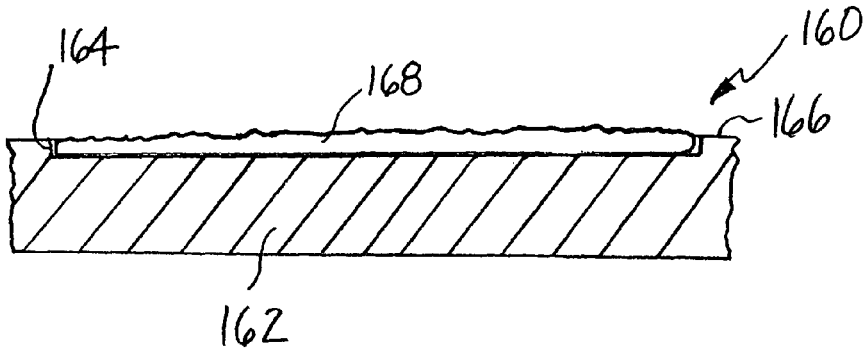
FIG. 11 is a sectional view of the patient transfer device of FIG. 10 taken along the lines 11-11 in FIG. 10.

Referring to FIGS. 10 and 11, a patient transfer device 160 includes a support pad 162 defining a recess 164 in an upper surface 166 of the pad. As shown in the top plan view of FIG. 10, the recess 164 has a rectangular periphery that is dimensioned for receipt of a correspondingly rectangular patient transfer mattress 168. Referring to the sectional view of FIG. 11, the depth that the recess 164 extends into the support pad 162 provides for receipt of the transfer mattress 168 such that the transfer mattress 168 is substantially flush with the upper surface 166 of the support pad 162 when the transfer mattress is in a deflated condition, as shown.

As shown in FIG. 10, the support pad 162 extends outwardly beyond the periphery of the recess 164 into side and end portions 170, 172. Constructed in this manner, the support pad 162 forms an overlay adapted for receipt on a supporting surface, such as that of a bed for example, having dimensions that exceed those of the transfer mattress 168. As shown in broken line in FIG. 10, the support pad 162 preferably includes straps 173 located on a bottom surface of the support pad 162 and extending across each of the corners of the bottom surface. The corner straps 173 are preferably made from an elastic material to facilitate engagement between the straps 173 and an underlying member such as a bed for limited movement between the support pad 162 and the underlying member. The overlay support pad 162, receiving a transfer mattress in a substantially flush manner, provides for a substantially uniform upper surface covering the underlying supporting surface in its entirety. The uniform surface provided by the overlay eliminates discomfort that might otherwise be presented because of edge transitions between the transfer mattress and the larger underlying bed surface.

The support pad 162 is shown comprising a solid interior, which could be any material such as a cotton-fill or a gel, for example. It is not a requirement, however, that the interior of support pad 162 comprise a solid material. It is within the scope of the invention that the interior of the support pad could comprise an inflatable chamber, or chambers.

Figure 12A:
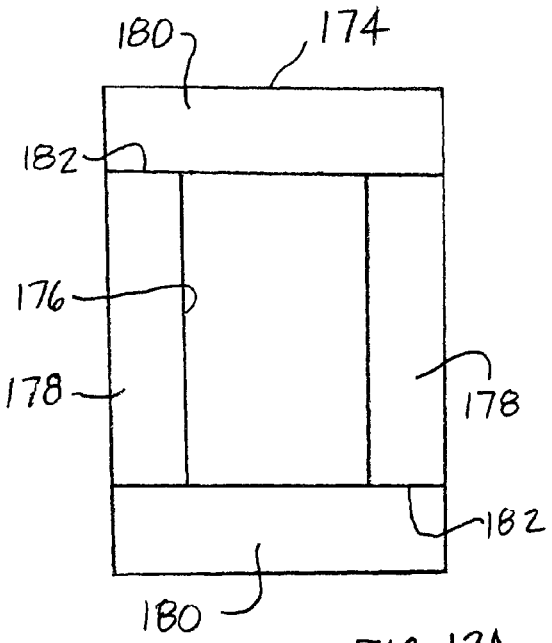
FIGS. 12A through 12C are support pads including a recess in an upper surface for receiving a transfer mattress, the support pads including detachable portions to facilitate sliding removal of a patient transfer mattress from the recess of the support pad.
Figure 12B:
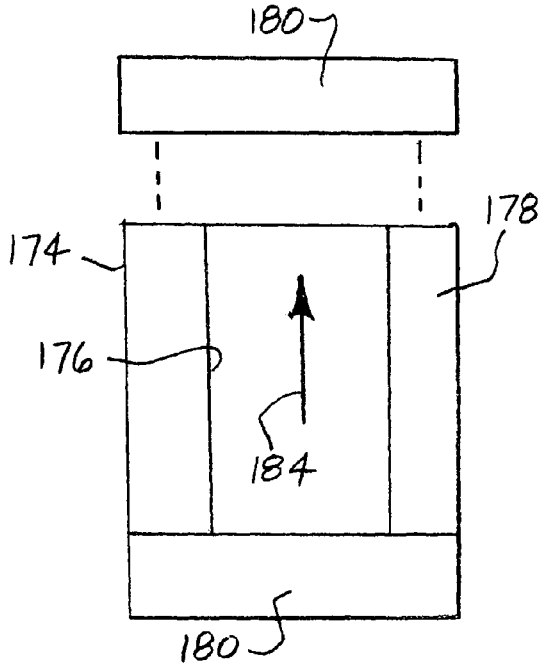

Referring to FIG. 12A, a support pad 174 includes a recess 176 in an upper surface for receiving a patient transfer mattress (not shown). The support pad 174 includes side and end portions 178, 180, that similar to those of support pad 162 extend beyond the periphery of the recess 176 to provide a substantially flush upper surface with a deflated transfer mattress received in the recess 176 when the pad is placed on an underlying support member, such as a bed, that is larger than the transfer mattress. The support pad 174 is sectioned, as indicated by sections lines 182. The section lines 182 extend laterally across the support pad 174 at the ends of the recess 176 to provide for detachment of the end portions 180 from the rest of the support pad 174 as shown in FIG. 12B. The detachment of one of the end portions 180 from the rest of the support pad 174 exposes the end of the recess 176 thereby facilitating sliding removal of a transfer mattress in endwise manner from the recess 176 of support pad 174 as illustrated in FIG. 12B by arrow 184. Any suitable means of releasably attaching the end portions 180 to the support pad 174 along section lines could be used including, for example, snaps, belts and hook and loop fasteners.

Figure 12C:
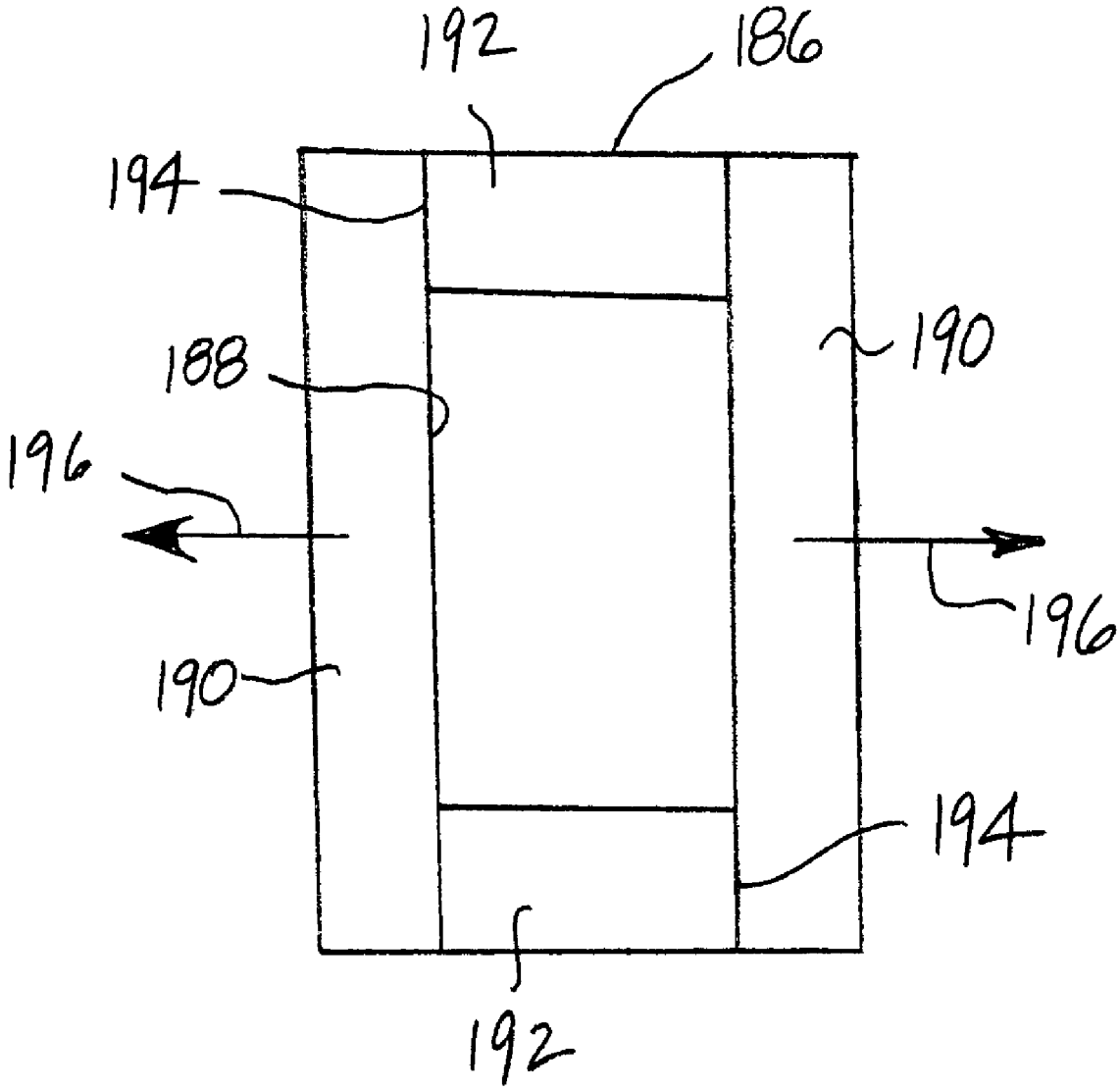
Figure 13:
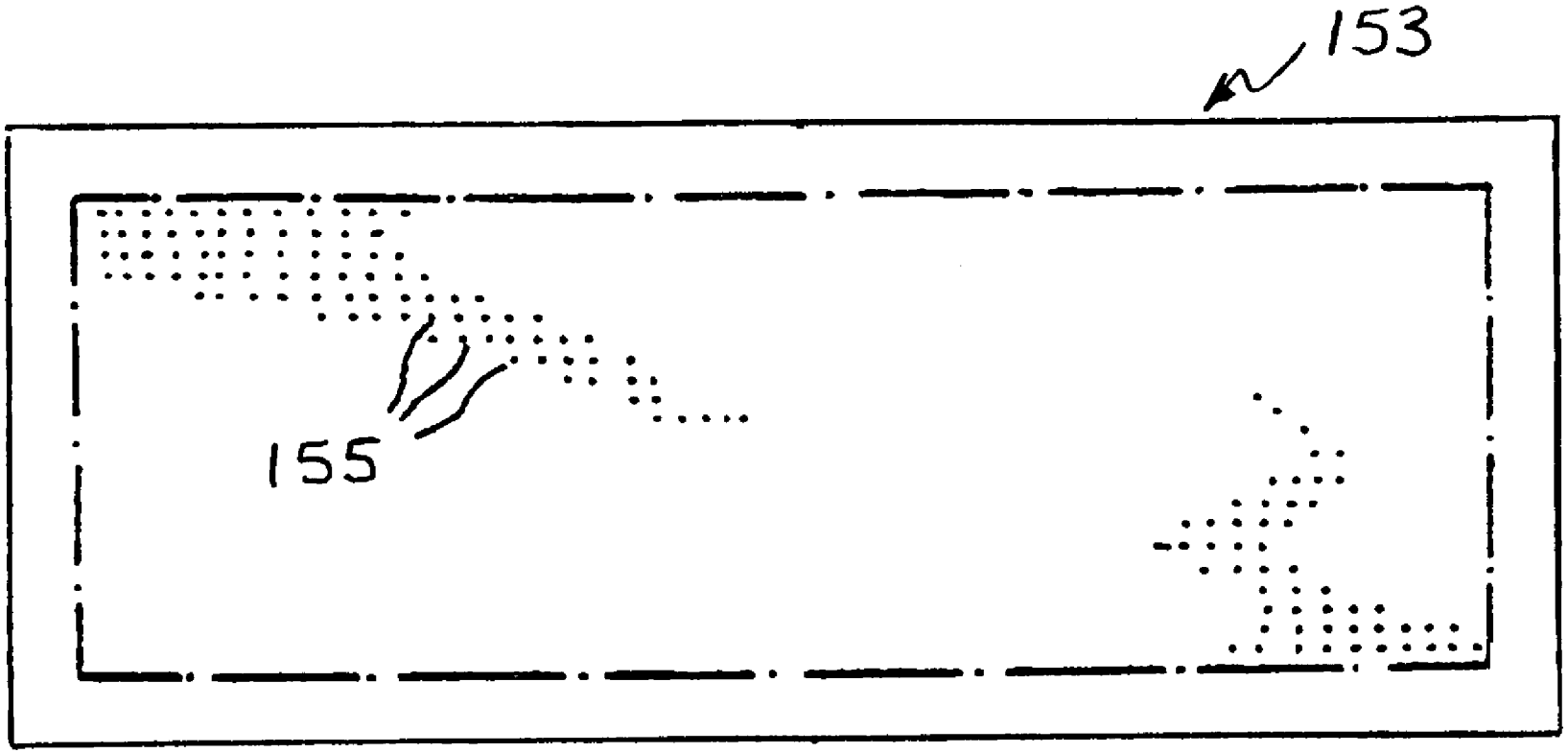
FIG. 13 shows a bottom sheet of an inflatable mattress including a plurality of small holes.

Referring to FIG. 12C, a support pad 186 includes a recess 188 for receiving a transfer mattress on an upper surface of the support pad 186. The support pad 186 includes side and end portions 190, 192 extending outwardly from the periphery of the recess 188. The support pad 186 is sectioned as indicated by section lines 194. As shown, the section lines 194 extend lengthwise with respect to the support pad 186 between the ends of the pad to provide for detachment of the side portions 190 from the support pad 186. The section lines 194 are located at the sides of the recess 188 such that detachment of one of the side portions 190 from the support pad 186 exposes the recess 188, thereby facilitating sliding removal of a transfer mattress in sidewise fashion from the recess 188 as indicated in FIG. 12C by arrows 196.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A patient transfer device comprising:

an inflatable transfer mattress;

an accessory located on an upper surface of the transfer mattress; and a support pad including a recess in an upper surface of the support pad for receiving the mattress, the recess having a depth such that an upper surface of the accessory is substantially flush with the upper surface of the support pad when the inflatable transfer mattress is in a deflated condition, the inflatable transfer mattress including holes in a bottom surface of the transfer mattress to facilitate sliding movement of the transfer mattress.

2. The patient transfer device according to claim 1, wherein the accessory is selected from the group consisting of:

(i) a therapeutic pad (ii) a flexible body litter with carry handles;

(iii) a non-absorbent sanitary cover;

(iv) a washable absorbent cover;

(v) a disposable cover;

(vi) a second inflatable air mattress with a pressure control valve; and (vii) a second inflatable air mattress with pulsating pressure control.

3. A patient transfer device comprising:

an inflatable transfer mattress having an upper surface; and a support pad including a recess in an upper surface of the pad for receiving the inflatable transfer mattress, the recess having a depth such that the upper surface of the inflatable transfer mattress is substantially flush with the upper surface of the pad when the inflatable transfer mattress is in a fully deflated condition, the inflatable transfer mattress including a plurality of holes in a bottom sheet of the mattress to create a cushion of escaping air beneath the transfer mattress to facilitate sliding movement of the transfer mattress with respect to the support pad.

4. The patient transfer device according to claim 3, wherein the recess in the support pad has a rectangular periphery defining opposite sides and opposite ends, and wherein the support pad extends outwardly from the periphery of the recess to define side and end portions such that the support pad forms an overlay adapted for placement on a support member that is larger than the transfer mattress received in the recess.

5. The patient transfer device according to claim 3, wherein the inflatable transfer mattress and the recess of the support pad are substantially rectangular, the support pad including side and end portions located on opposite sides and ends of the recess, and wherein at least one of either of the side and end portions of the support pad is detachably connected to the support pad to facilitate sliding removal of the inflatable transfer mattress from the recess of the support pad.

6. The patient transfer device according to claim 5, wherein both of the end portions of the support pad are detachably connected to the support pad to facilitate sliding removal of the inflatable transfer mattress from the recess support pad in lengthwise fashion with respect to the support pad from either one of the opposite ends of the recess.

7. The patient transfer device according to claim 5, wherein both the side portions of the support pad are detachably connected to the support pad to facilitate sliding removal of the inflatable transfer mattress from the recess of the support pad in sidewise fashion with respect to the support pad from either one of the opposite sides of the recess.

* * * * *